US007918160B2

(12) United States Patent
Roy

(10) Patent No.: US 7,918,160 B2
(45) Date of Patent: Apr. 5, 2011

(54) CANE JUICE EXTRACTOR

(76) Inventor: J. Edwin Roy, Lafayette, LA (US)

( * ) Notice: Subject to any disclaimer, the term of this patent is extended or adjusted under 35 U.S.C. 154(b) by 139 days.

(21) Appl. No.: 12/457,243

(22) Filed: Jun. 4, 2009

(65) Prior Publication Data

US 2010/0307483 A1 Dec. 9, 2010

(51) Int. Cl.
*B30B 9/20* (2006.01)

(52) U.S. Cl. ..... 100/121; 100/98 R; 100/100; 100/118; 100/130; 100/131; 100/176

(58) Field of Classification Search ..... 100/94, 100/96, 97, 98 R, 100, 102, 104, 118, 121, 100/130, 131, 153, 161, 172, 176; 99/495, 99/509

See application file for complete search history.

(56) References Cited

U.S. PATENT DOCUMENTS

| | | | | |
|---|---|---|---|---|
| 3,394,535 | A | 7/1968 | Roberts | |
| 4,407,111 | A | 10/1983 | Brune et al. | |
| 4,546,698 | A * | 10/1985 | Bouvet | 100/121 |
| 5,031,392 | A | 7/1991 | Baker | |
| 5,320,035 | A | 6/1994 | Sanchez et al. | |
| 6,068,869 | A * | 5/2000 | Bent Ginslov | 426/262 |
| 6,230,477 | B1 * | 5/2001 | Caillouet | 56/14.5 |
| 6,245,153 | B1 * | 6/2001 | Gonzales | 127/55 |
| 6,508,049 | B1 | 1/2003 | Cox et al. | |
| 6,807,799 | B2 | 10/2004 | Reaux | |
| 6,928,800 | B2 | 8/2005 | Huff, Jr. | |
| 2001/0002037 | A1 | 5/2001 | Cullinger | |
| 2005/0016145 | A1 | 1/2005 | Huff, Jr. | |
| 2005/0081498 | A1 | 4/2005 | Harvey | |
| 2009/0241944 | A1 * | 10/2009 | Cullinger | 127/2 |

FOREIGN PATENT DOCUMENTS

WO WO 93/16794 9/1993

OTHER PUBLICATIONS

Sugarcane Juice Extractor, http://www.global-b2b-network.com/b2b/17/185/page3/286883.sugarcane_juice_extractor.html , 2 pages printed from the Internet on Dec. 29, 2008.

* cited by examiner

*Primary Examiner* — Jimmy T Nguyen
(74) *Attorney, Agent, or Firm* — Richard C. Litman

(57) ABSTRACT

The cane juice extractor includes a wagon that may be hitched to or towed alongside a harvesting machine or combine for application in-field. The wagon includes a frame having an upper deck and a lower deck. The upper deck includes an inlet side where harvested cane may be fed for juice extraction and an outlet side for disposing the pulp. Rotating feeders feed the cane to a cutting station on the upper deck. The cutting station comminutes the cane into billets that are carried by an endless belt through a series of compression roller sets. Each set of rollers compress the cut cane down to smaller dimensions to extract the juice. A chute disposed between the upper and lower decks collects the juices and funnels them into a juice storage tank on the lower deck. The pulp is expelled from the outlet side to the field.

11 Claims, 6 Drawing Sheets

CANE JUICE EXTRACTOR

BACKGROUND OF THE INVENTION

1. Field of the Invention

The present invention relates to agricultural product processors, and more specifically to a cane juice extractor for in-field extraction of juice from sugar canes.

2. Description of the Related Art

Sugar is one of the most basic ingredients present in the kitchens of most homes. It imparts the sweet flavor that many enjoy from drinks, candy, and desserts to savory dishes. One of the most common types of sugars consumed by the general public is sucrose derived from sugar cane.

In general, sugar cane growers or farms utilize manual labor and/or machinery to harvest ripe sugar canes. The harvested sugar cane stalks are sent to a processing plant remote from the field where they are cut into billets. The billets are processed to extract the juices. Once the juice has been extracted, the juice is sent to refineries to obtain the final product.

One of the biggest concerns with the above is the potential loss of raw material for juice extraction, i.e., not the sugar cane itself but the contents therein. Sugar cane, once cut, must be expeditiously transported to the processing plant because the cut cane begins to lose its sugar content. This issue is exasperated by the damage inflicted on the cane during mechanical harvesting since it accelerates the decay.

One proposed solution involves a trailer that may be towed by a harvester. The trailer contains an overly complex array of systems that comminute the harvested cane and extract juices. While this system appears to perform well, the potential costs in maintenance and upkeep may not be appealing to most farmers with limited financial resources. Thus, it would be beneficial in the art to provide a juice extracting device that maximizes use of raw materials by being functional in the field while being relatively simple in construction and upkeep.

Thus, a cane juice extractor solving the aforementioned problems is desired.

SUMMARY OF THE INVENTION

The cane juice extractor includes a wagon that may be hitched to or towed alongside a harvesting machine or combine for application in-field. The wagon includes a frame having an upper deck and a lower deck. The upper deck includes an inlet side where harvested cane may be fed for juice extraction and an outlet side for disposing the pulp. Rotating feeders feed the cane to a cutting station on the upper deck. The cutting station comminutes the cane into billets that are carried by an endless belt through a series of compression roller sets. Each set of rollers is configured to compress the cut cane down to smaller dimensions to thereby extract the juice. A chute disposed between the upper and lower decks collects the juices and funnels them into a juice storage tank on the lower deck. The pulp is expelled from the outlet side to be reintroduced into the field. Fans or blowers are disposed on both the inlet and outlet sides to respectively filter out debris prior to cutting and direct juices down the chute. The chute includes a filtering system to filter out pulp and other debris. The lower deck also includes a controller/generator connected to a fuel source.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a cane juice extractor that can be used in situ or on the field. The relative simple construction lends itself to inexpensive and easy upkeep. It is noted that although the following describes the cane juice extractor used for sugar cane, the invention may also be used for other plant matter for juicing purposes.

Figure 1:
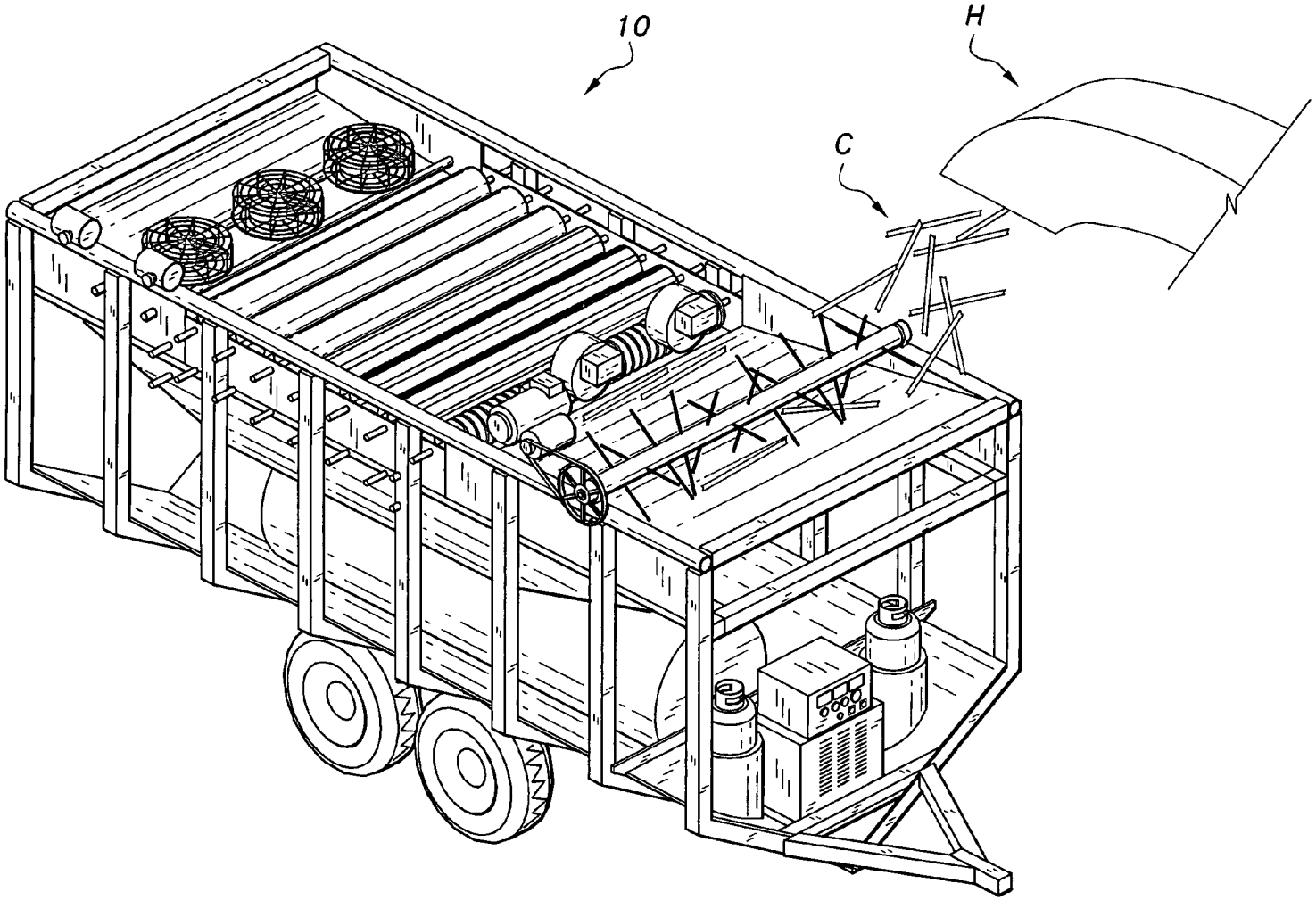
FIG. 1 is an environmental, perspective view of a cane juice extractor according to the present invention.
Figure 2:
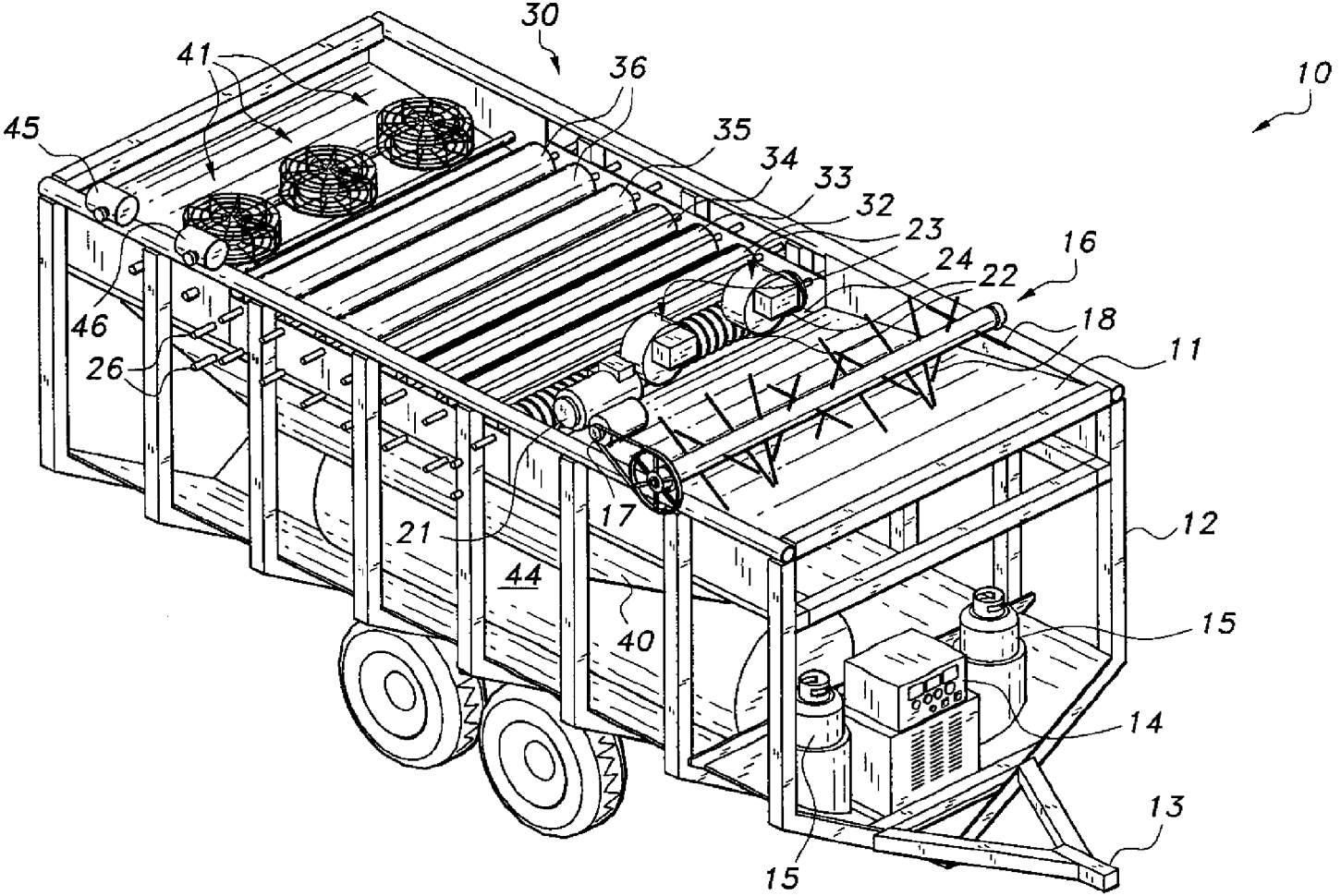
FIG. 2 is a perspective view of the can juice extractor according to the present invention.

As shown in FIGS. 1 and 2, the cane juice extractor, generally referred to by reference number 10 herein, includes a wagon having a frame 12 with a hitch 13 at the front thereof. The hitch 13 allows the cane juice extractor 10 to be towed by a harvester H or towed alongside such a harvester via another vehicle. The wagon frame 12 is separated into an upper deck and a lower deck with most of the juice extracting systems disposed on the upper deck. The lower deck includes a removable juice storage or holding tank 44 and the controller/generator 14.

Figure 3:
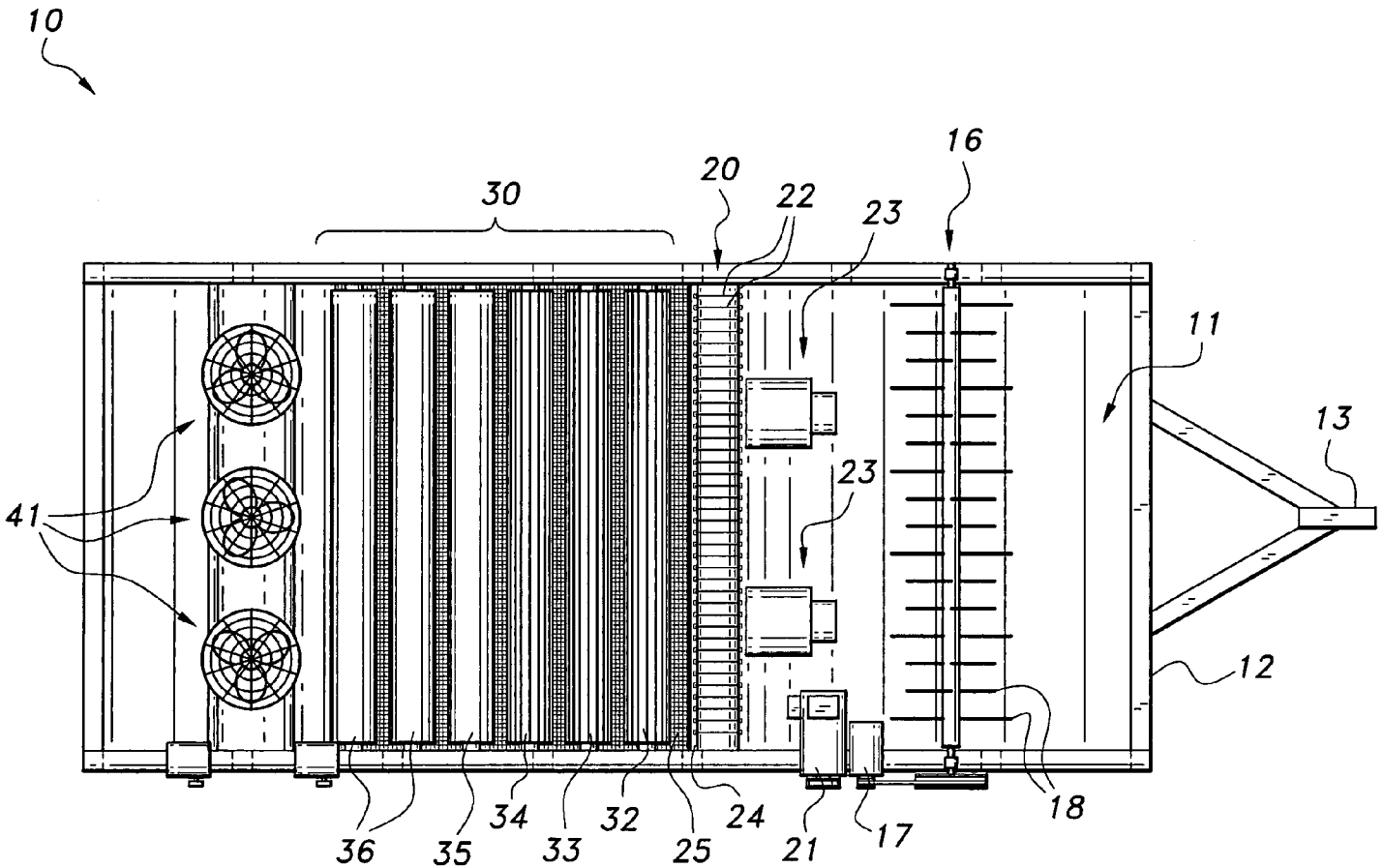
FIG. 3 is a top view of the can juice extractor according to the present invention.
Figure 4:
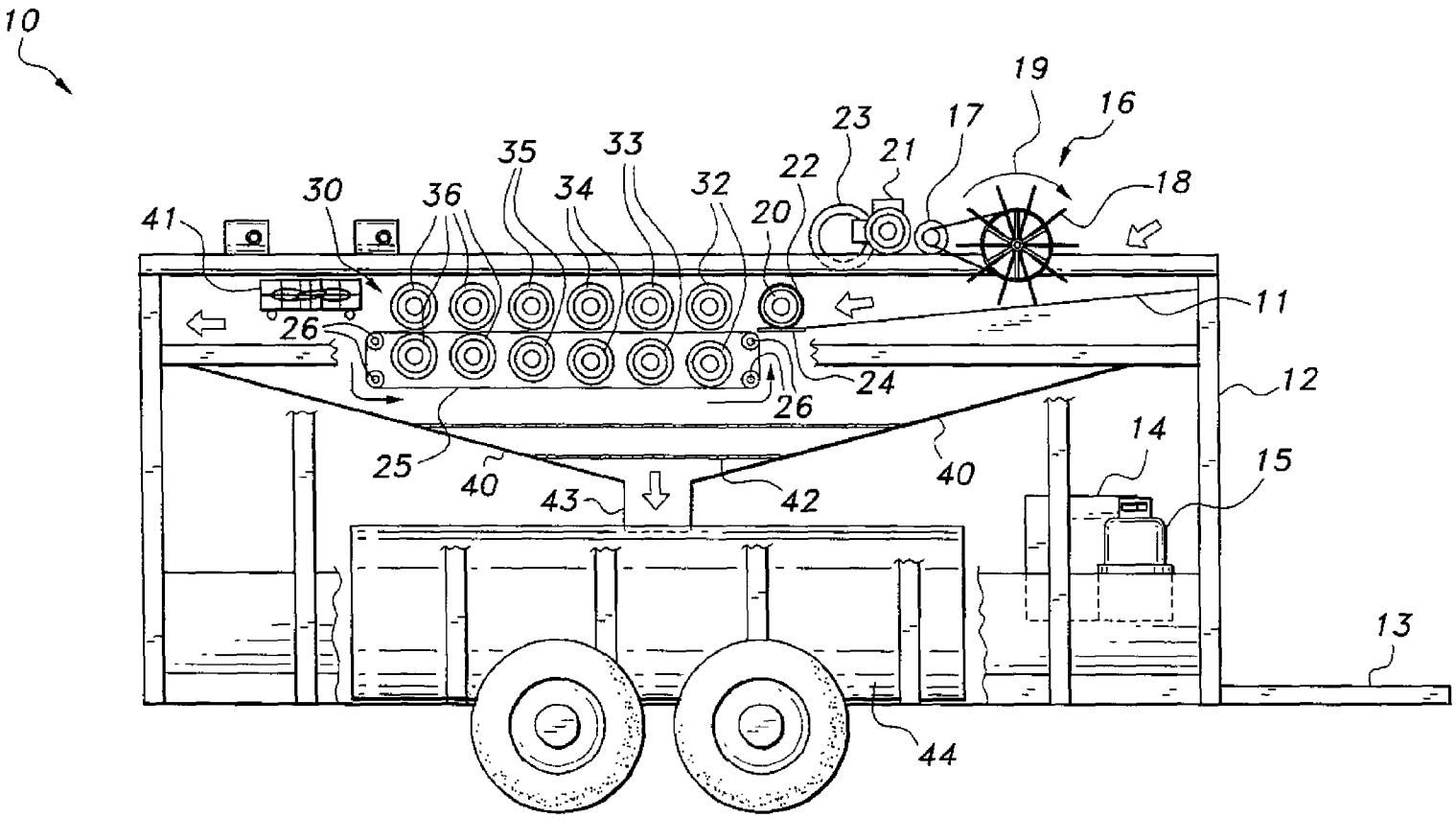
FIG. 4 is a side view of the can juice extractor according to the present invention.
Figure 5:
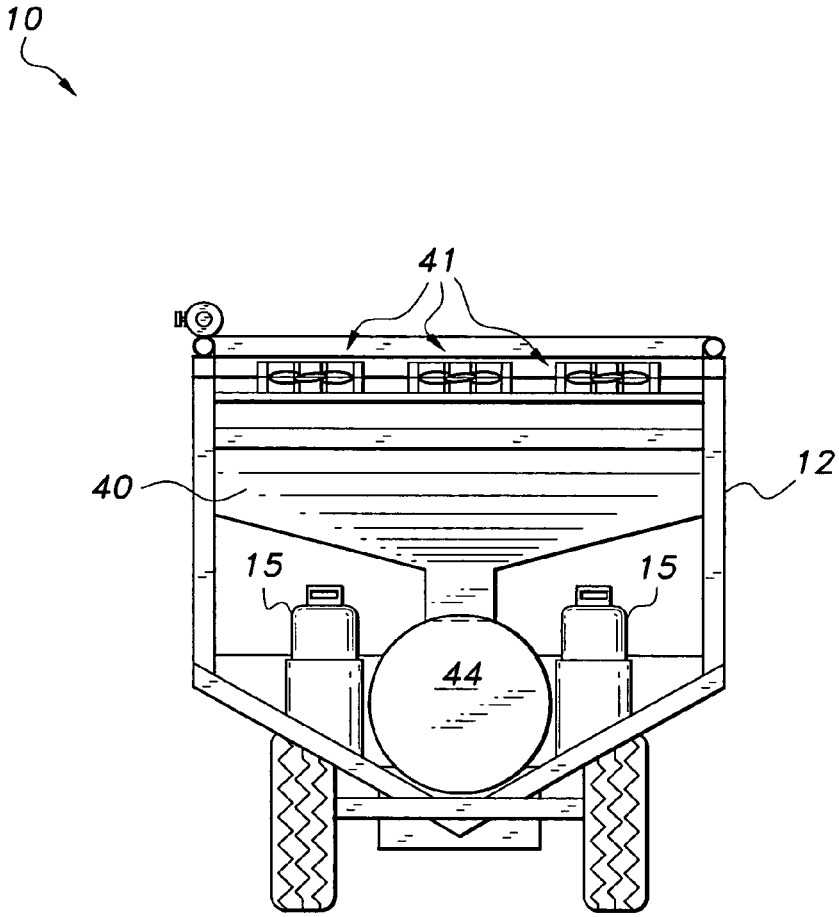
FIG. 5 is a rear view of the can juice extractor according to the present invention.

Referring to FIGS. 3 and 4, the upper deck includes an inlet side defined by a feed chute 11. The harvester H supplies harvested cane C to the feed chute 11, which directs them to the feeder 16. The feeder 16 includes a plurality of feeder prongs 18 mounted to a rotating shaft to propel and direct the harvested cane to the cutting station 20. Note the rotating direction indicated by arrow 19. A feeder motor 17 powers the feeder 16. While the harvested cane C is being fed to the cutting station 20, a pair of blowers 23 disposed between the cutting station 20 and the feeder 16 directs pressurized air to the cane to blow away leaves, dirt, loose plant matter and other refuse. Fans may also be used in place of the blowers 23.

The cutting station 20 includes a plurality of cutting blades 22 mounted on a shaft and spaced a predetermined distance apart from each other. The harvested cane C is approximately 12 in. long and the spacing of the cutting blades 22 permits comminuting of the cane into about 2¾ in. lengths. The above lengths are exemplary since the cane juice extractor 10 is fully capable of handling other lengths of canes and billets. In the current configuration, the cutting blades 22 are preferably saw blades but other cutting blades such as choppers may be used in place thereof. A backing plate 24 with a plurality of slots corresponding to the cutting blades 22 is operatively disposed below the cutting blades 22 to thereby provide a surface for cutting the fed cane. A motor 21 powers operation of the cutting station 20.

The cut billets are then fed to a juice extracting station 30 on the upper deck of the wagon frame 12. The juice extracting station 30 includes an endless conveyor belt 25, which receives the billets and passes them through a series of compression roller sets 32, 33, 34, 35, 36. The conveyor belt 25 is preferably a loop of stainless steel mesh where the holes in the mesh allow juices to fall through. Other similar conveyor belts composed of rubber, textiles or composites are also possible. The conveyor belt 25 is wound around idle and driven rollers 26 providing sufficient tension for operation. A motor 45 drives the rollers 26.

Each set of compression rollers 32, 33, 34, 35, 36 are configured to progressively press the billets fed therethrough to squeeze the juice contained therein. For example, the first set of compression rollers 32 press the billets down to about 9/16 in. with a pressure of 2,000 psi. The second set of compression rollers 33 press the billets down to 7/16 in. with a pressure of 2,000 psi. The third set of compression rollers 34 press the billets down to 5/16 in. at 2,000 psi., the fourth set of compression rollers 35 press the billets to 3/16 in. at 2,000 psi., and the fifth set of compression rollers 36 press the billets to 1/8 in. at 5,000 psi. Thus, it can be seen that each set 32-36, squeezes the billets down to smaller dimensions as they are fed past subsequent compression rollers 32-36. A number of ways may be used to facilitate this process. For example, each set of rollers 32-36 may have the nip, i.e. the spacing between the rollers, set to the desired level for the set point of billet compression. The diameter of each set of rollers may be varied for similar results. To set the pressure, having the nip adjusted to the proper levels and locked therein may provide the desired pressure, or additional mechanical means such as hydraulics or tension springs may also be used. In the current embodiment, the nip between the rollers of each set has been set to progressively decrease the dimension of the billets. Some of the rollers such as roller sets 32, 33, 34 may be ridged to enhance grip on the billets. A motor 46 powers the compression rollers 32-36.

To collect the juice, the cane juice extractor 10 includes a chute 40 disposed between the upper and lower decks of the wagon frame 12. The chute 40 underlies the juice extracting station 30 and spans substantially the length of the wagon frame 12 to maximize juice collection. The extracted juice is funneled to outlet 43 connected to the juice storage or holding tank 44. The chute also includes a filtration system defined by filters 42. The filters trap undesirable plant debris and pulp from falling into the tank 44 along with the juice. The filtration system may be a two-stage process where the upper filter 42 filters out larger debris while the lower filter 42 filters out the rest.

After the billets pass through the juice extracting station, the resulting pulp is expelled to the field. Due to the pressure and the momentum from the last set of the compression rollers 36, this provides enough motive force to direct the pulp to the outlet side of the upper deck. As shown in FIGS. 3 and 4, the outlet side includes a plurality of fans 41 disposed along the width of the wagon frame 12 directing air downward towards the chute 40. This forces the leftover juices in the pulp or the juices collected on the outlet side of the chute 40 to be directed towards the outlet 43.

The operation of the cane juice extractor 10 is provided by a controller/generator 14 disposed near the front of the wagon frame 12. The controller/generator 14 generates power for the cane juice extractor 10 and controls activation and speed of the feeder 16, cutting station 20, juice extracting station 30 as well as the blowers 23 and fans 41. The fuel source for the controller/generator 14 may be a pair of propane tanks 15 disposed in their own mounts on either side of the controller/generator 14. Alternative fuels or power sources may also be used such fuel cells, batteries and/or solar panels.

Figure 6:
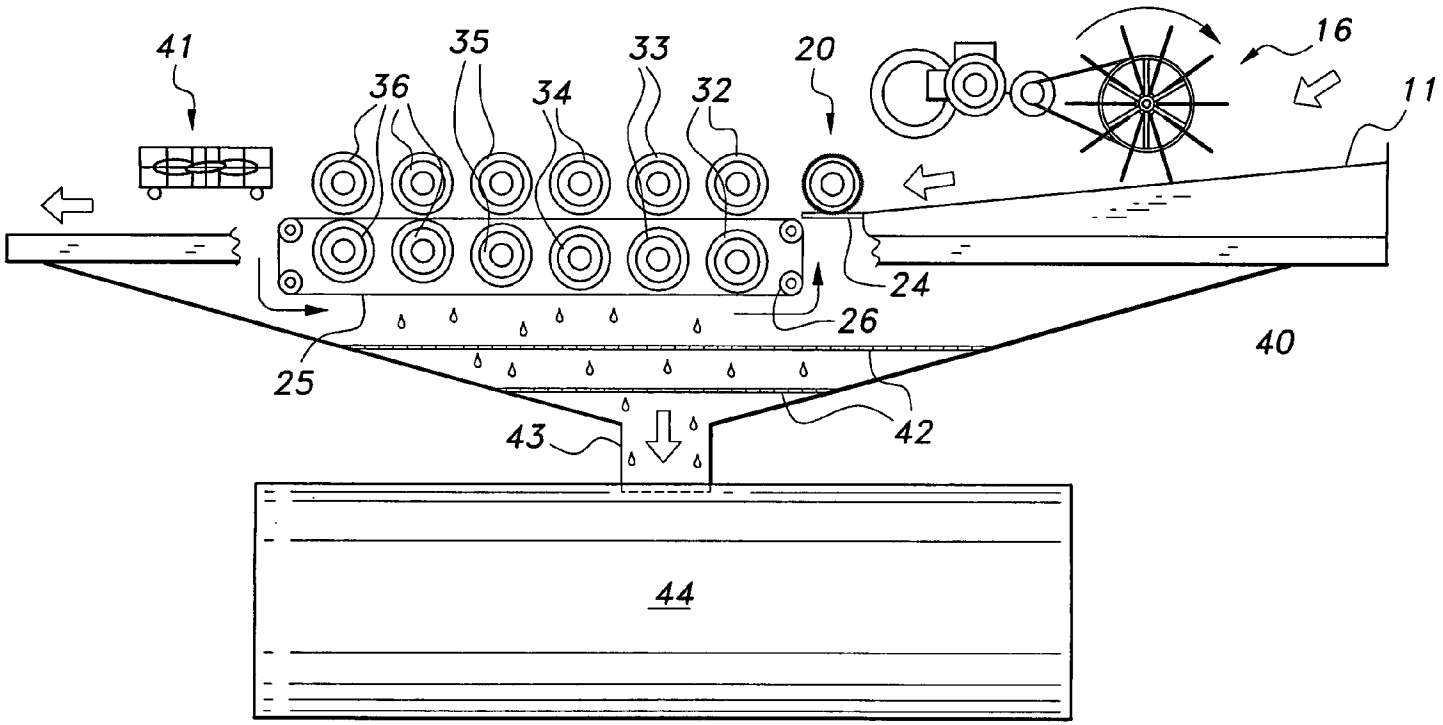
FIG. 6 is a schematic, side view of the can juice extractor according to the present invention showing the juice extraction process.

Referring to FIG. 6, the following describes how the cane juice extractor 10 operates. The harvested cane C is delivered to the inlet side of the wagon frame 12. The feed chute 11 directs the cane C to feeder 16, which positively feeds the cane C to the cutting station 20. The blowers 23 ensure that the cane C is free of leaves and other refuse. The cutting station 20 cuts the cane C into smaller billets that are then loaded onto conveyor 25 in the juice extracting station 30. Each set of subsequent compression rollers 32-36 progressively presses the billets down to a smaller size to squeeze or extract the juice contained therein. The extracted juice falls through the mesh on the conveyor 25 to the filters 42. The filters 42 ensure that much of the unwanted pulp and other debris do not fall into the storage tank 44. Any juice collected on the outlet side of the chute 40 is forced down the chute by the fans 41. Once the tank 44 has been filled, the tank is removed from the wagon frame 12 and sent to the processing plant. In this manner, it has been found that the cane juice extractor 10 maximizes juice yield by minimizing the loss thereof.

It is understood that the cane juice extractor 10 is not limited to the above but encompasses a variety of alternatives. For example, it is preferable that the cane juice extractor is made from stainless steel, but other alternative materials may be used as long as they are durable and long lasting. The chute 40 and the feed chute 11 may be coated to reduce surface tension or friction to efficiently move the cane through extraction station and collect the juice. In addition, the number of sets of compression rollers may be increased or decreased depending on the desired compression.

It is to be understood that the present invention is not limited to the embodiments described above, but encompasses any and all embodiments within the scope of the following claims.

I claim:

1. A cane juice extractor, comprising:

a wagon adapted to be towed by a vehicle, the wagon having a frame, the frame having an upper deck and a lower deck, the upper deck having:

an inlet side for receiving harvested cane;

a feeder for directing the cane;

a cutting station for cutting the cane into billets;

a juice extracting station for progressively compressing the billets to extract juice contained in the billets; and an outlet side for expelling billet pulp;

a juice collecting chute disposed between the upper and lower decks to collect and direct flow of the juice;

a storage tank disposed on the lower deck and connected to the juice collecting chute to hold the extracted juice;

a first positive air flow assembly for cleaning debris on the harvested cane;

a second positive air flow assembly for directing residual juices down the juice collecting chute; and a controller/generator disposed on the lower deck to provide power and control operation of cane juice extractor.

2. The cane juice extractor according to claim 1, wherein the inlet side further comprises an inclined feed chute directing flow of the harvested cane to the feeder.

3. The cane juice extractor according to claim 1, wherein the feeder further comprises a plurality of feed prongs mounted on a rotatable shaft.

4. The cane juice extractor according to claim 1, wherein the cutting station further comprises:

a rotatable shaft;

a plurality of cutting blades mounted to and spaced along the rotatable shaft;

and a backing plate disposed below the cutting blades, the backing plate having a plurality of spaced slots corresponding to the cutting blades.

5. The cane juice extractor according to claim 1, wherein the juice extracting station further comprises:

a plurality of sets of compression rollers adapted to progressively press the billets into smaller dimensions, each of the sets of compression rollers being configured to press the billets into a given dimension different from the other sets; and a conveyor for feeding the billets through the plurality of sets of compression rollers.

6. The cane juice extractor according to claim 5, wherein the conveyor further comprises an endless meshed conveyor belt.

7. The cane juice extractor according to claim 1, wherein the juice collecting chute further comprises a filtration system disposed inside the chute and underlying the juice extracting station to filter out pulp and debris.

8. The cane juice extractor according to claim 7, wherein the filtration system comprises an upper and lower filter.

9. The cane juice extractor according to claim 1, wherein the first positive air flow assembly further comprises a plurality of air blowers disposed along a width of the upper deck between the feeder and the cutting station, the air blowers directing air towards the inlet side.

10. The cane juice extractor according to claim 1, wherein the second positive air flow assembly further comprises a plurality of fans disposed along a width of the upper deck adjacent the outlet side, the fans directing air toward the juice collecting chute to force juice down the juice collecting chute.

11. The cane juice extractor according to claim 1, further comprising at least one fuel source disposed adjacent the controller/generator.

* * * * *